United States Patent [19]

Keith

[11] 4,432,936

[45] Feb. 21, 1984

[54] METHOD FOR ADDING INSOLUBLE MATERIAL TO A LIQUID OR PARTIALLY LIQUID METAL

[75] Inventor: Earl K. Keith, Clute, Tex.

[73] Assignee: The Dow Chemical Company, Midland, Mich.

[21] Appl. No.: 412,349

[22] Filed: Aug. 27, 1982

[51] Int. Cl.[3] ..... C22C 1/02; C22C 32/00

[52] U.S. Cl. ..... 420/590; 75/10 R; 75/65 R

[58] Field of Search ..... 75/10 R, 65 R; 420/590; 148/405, 406, 408, 409, 411, 415

[56] References Cited

U.S. PATENT DOCUMENTS

| | | | |
|---|---|---|---|
| 3,902,544 | 9/1975 | Flemings et al. | 164/71 |
| 3,936,298 | 2/1976 | Mehrabian et al. | 420/590 |
| 3,948,650 | 4/1976 | Flemings et al. | 420/590 |
| 3,951,651 | 4/1976 | Mehrabian et al. | 420/590 |
| 3,954,455 | 5/1976 | Flemings et al. | 420/590 |
| 4,174,214 | 11/1979 | Bennett et al. | 148/11.5 M |

*Primary Examiner*—L. Dewayne Rutledge
*Assistant Examiner*—Christopher W. Brody

[57] ABSTRACT

The invention is a method for adding substantially insoluble material to an at least partially liquid metal. The method comprises providing a combination of a first metal having discrete degenerate dendrites and a plurality of insoluble particles at least partially suspended in the first metal. The combination is mixed with a second metal at a temperature above the solidus temperature of the first metal and the second metal. The second metal is capable of forming a dendritic structure when cooled from a liquid state to a solid state. The mixture is then solidified into a dendritic-containing metallic structure having a plurality of substantially insoluble particles at least partially suspended in the structure.

9 Claims, No Drawings

METHOD FOR ADDING INSOLUBLE MATERIAL TO A LIQUID OR PARTIALLY LIQUID METAL

BACKGROUND OF THE INVENTION

This invention relates to metals having insoluble materials distributed therein, and particularly to a convenient method for adding insoluble materials to a liquid or partially liquid metal.

Solid insoluble materials are commonly added to at least partially liquid metals to provide desirable characteristics to the solidified product obtained therefrom. For example, solid materials which are softer than the metal are added to provide desirable characteristics to the solidified product thereof when it is used as a bearing. Likewise, materials which are harder than the metal are added to extend the life of the solidified product thereof when it is subjected to extreme friction forces. However, it is difficult to add more than about 3 weight percent of an insoluble material to a liquid or partially liquid metal because the insoluble material is generally rejected by the metal and either floats to the surface or sinks to the bottom thereof. Severe and lengthy agitation is generally required to distribute the material into the liquid or partially liquid metal. This distribution method is time consuming and is limited to the addition of relatively small amounts of insoluble material to a metal.

Methods have recently been developed by which up to about 30 weight percent of an insoluble material may be blended with an at least partially liquid metal. These methods are described in U.S. Pat. Nos. 3,948,650; 3,951,651; and 4,174,214. These methods require careful temperature control, special melting equipment and special agitation equipment. Such equipment is expensive and not always readily available at some locations.

A method to easily distribute insoluble material into a liquid or partially liquid metal without the need of severe and lengthy agitation would be desirable. The invention provides such a method.

SUMMARY OF THE INVENTION

The invention is a method for adding substantially insoluble material to an at least partially liquid metal. The method comprises providing a combination of a first metal having discrete degenerate dendrites and a plurality of insoluble particles at least partially suspended in the first metal. The suspension is mixed with a second metal at a temperature above the solidus temperature of the first metal and the second metal. The second metal is one which is capable of forming a dendritic structure when cooled from a liquid state to a solid state. The mixture is then solidified into a dendritic-containing metallic structure having a plurality of substantially insoluble particles at least partially suspended in the structure.

DETAILED DESCRIPTION OF THE INVENTION

First metal/insoluble particle combinations suitable for use in the present invention and methods for forming such combinations are described in U.S. Pat. Nos. 4,174,214; 3,936,298; 3,954,455; 3,902,544; 3,948,650 and 3,951,651. The teachings of these patents are herein incorporated by reference.

Metals which are suitable for use as the first metal and for use as the second metal are described in the above patents and are those which, when solidified from a liquid state without agitation, form a dendritic structure. Representative metals include magnesium, aluminum, iron, copper, lead, zinc, nickel, cobalt and alloys or mixtures thereof.

Substantially insoluble particles which are suitable for use in the present invention are also described in the above patents and are materials which, when incorporated in a metal, modify the physical characteristics of the solidified product obtained therefrom, as compared to the solid metal itself. Suitable materials must be substantially chemically inert to, and substantially completely insoluble in, both the first metal and the second metal. Representative materials which are suitable for most applications include metal carbides such as silicon carbide, magnesium aluminate, fummed silica, silica, titanium sponge, graphite, metal carbides, sand, glass, ceramics, pure metals, metal alloys and metal oxides such as thorium oxide and aluminum oxide.

It has been discovered that the first metal/insoluble particle combination may be used as a carrier to introduce insoluble material into a second metal. By mixing the combination with the second metal at a temperature above the solidus temperature of both the first metal and the second metal, the insoluble material in the combination is easily distributed into the second metal.

In practicing the invention, the first metal/insoluble particle combination is provided which is produced according to a method in one of the patents incorporated by reference above. The combination contains a known amount of insoluble material suspended in a known amount of the first metal. The amount of the combination to mix with the second metal may be easily calculated and depends upon (1) the desired concentration of insoluble material in the final product, (2) the amount of second metal to be used, and (3) the concentration of insoluble material in the first metal/insoluble particle combination. Since the combinations contain up to about 30 weight percent of insoluble material, it is possible to produce products having near 30 weight percent insoluble material. However, most desired products contain less than about 10 weight percent insoluble material and most commonly contain less than about 5 weight percent insoluble material.

The first metal/insoluble material combination may be initially contacted with the second metal while each is solid or while either or both are at least partially liquid. After being initially contacted, they are mixed while at a temperature in excess of the solidus temperature of both the first metal and the second metal to distribute the insoluble material in the mixture.

Thermal currents in the so-formed mixture and the random motion of the first metal, the second metal and the insoluble material are usually sufficient to provide the amount of agitation needed to at least partially homogenize the mixture. However, it is preferable to provide additional agitation to minimize the mixing time and to enhance the distribution of the insoluble material into the mixture. Additional agitation may be provided by a mixer, physical vibration, ultrasonic vibration or stirring.

In this way, the substantially insoluble material is easily distributed throughout the mixture. However, the insoluble material has a tendency to settle to the bottom of the mixture unless stirring or agitation is continued. Hence, it is desirable to continue stirring or agitation until the mixture is ready for solidification.

The mixture is then solidified using ordinary metal processing techniques such as high pressure die casting, low pressure die casting or sand casting. These ordinary metal processing techniques are the type that produce solid metals having a dendritic structure. Such methods are well known in the art and need no further elaboration. It is unnecessary to use special processing techniques to produce solid metals which have a degenerate dendritic structure.

A protective atmosphere or a covering, such as a salt flux, may be used to minimize oxidation of the metals or metal alloys during heating and mixing. Means to prevent metals from oxidizing are well known in the art and need no extensive elaboration.

EXAMPLE 1

Two hundred pounds of AZ-91-B magnesium alloy (as a second metal) having a nominal composition of about 9 weight percent Al, 0.7 weight percent Zn, 0.2 weight percent Mn and the remainder Mg, were melted in a furnace using gas heating. A protective atmosphere was provided above the melt to minimize oxidation of the magnesium. The protective was about 0.3 percent $SF_6$, with the remainder being 50 percent $CO_2$ and about 50 percent air. The method was heated to a temperature of about 650° C. This temperature is in excess of the second metal's liquidus temperature. Throughout most of the run, the temperature of the molten alloy ranged from about 610° C. to about 640° C. After the AZ-91-B alloy was completely melted, 40 pounds of a solidified first metal/insoluble particle combination, produced according to the teachings of U.S. Pat. No. 4,174,214, were added to the molten AZ-91-B alloy. The combination contained about 20 weight percent aluminum oxide (as a substantially insoluble material) and about 80 percent AZ-91-B magnesium alloy containing degenerate dendrites (as a first metal).

The temperature of the second metal was 625° C. when the combination was added, but dropped to about 611° C. within a few minutes. Heat was continually applied to the mixture. Ten minutes after the combination had been added, agitation was initiated using a ⅓ horsepower motor mounted at an 80 degree angle to the surface of the mixture and connected to a shaft having a 3.8 inch diameter mixer blade on one end. The speed of the motor was adjusted to about 370 revolutions per minute (rpm). The heat from the second metal and the externally provided heat caused the first metal (in the combination) to melt releasing the substantially insoluble particles. The particles, the first metal and the second metal were thereby mixed. Samples taken of the final product showed a composition of 3.3 weight percent aluminum oxide.

EXAMPLE 2

One hundred twenty-four pounds of AZ-91-B (a second metal) were melted using an electrical resistance furnace. A protective atmosphere was provided above the melt. The atmosphere was composed of about 0.3 percent $SF_6$ with the remainder being about 50 percent air and about 50 percent $CO_2$. When the second metal was at a temperature of 660° C., 10 pounds of a first metal/insoluble material combination produced according to the process described in U.S. Pat. No. 4,174,214 were added to the metal. This combination had a composition of about 20 weight percent of a 320 U.S. Standard mesh, aluminum oxide (alpha - $Al_2O_3$) and about 80 percent AZ-91-B magnesium alloy having degenerate dendrites.

Ten minutes after the combination was added, agitation was started using the same agitation source as described in Example 1. The motor speed was adjusted to about 350 rpm. Twenty minutes after agitation was started, and while the mixture was of a temperature of about 650° C., the mixture was die-cast in a test panel die on a 300 ton, cold chamber die-casting machine using standard magnesium die-casting techniques. Casting was continued over about a three hour period. Analysis of the resulting castings showed the $Al_2O_3$ to be substantially homogeneously dispersed throughout the casting and to be about 1.4 percent of the total weight of the product.

What is claimed is:

1. A method for adding substantially insoluble material to an at least partially liquid metal comprising:
   (a) providing combination of a first metal having discrete degenerate dendrites and a plurality of substantially insoluble particles at least partially suspended in the first metal;
   (b) mixing the composite with a second metal at a temperature greater than the solidus temperature of both the first metal and the second metal, said second metal being capable of forming a dendritic structure upon cooling from a liquid state to a solid state; and
   (c) solidifying the mixture into a dendritic structure having a plurality of substantially insoluble particles at least partially suspended in the structure.

2. The method of claim 1 wherein the first metal and the second metal have substantially the same chemical composition.

3. The method of claim 1 wherein the mixture is solidified during casting.

4. The method of claim 1 wherein the first metal and the second metal are independently selected from the group consisting of magnesium, aluminum, copper, iron, lead, zinc, nickel, cobalt and alloys thereof.

5. The method of claim 1 wherein the first metal and the second metal are independently selected from the group consisting of magnesium, aluminum or alloys thereof.

6. The method of claim 1 wherein the substantially insoluble material is selected from the group consisting of graphite, metal carbides, sand, glass, ceramics, metal oxides, substantially pure metals and metal alloys.

7. The method of claim 1 wherein the substantially insoluble material is a metal oxide.

8. The method of claim 7 wherein the metal oxide is an oxide of aluminum.

9. A method for adding substantially insoluble material to an at least partially liquid metal comprising:
   (a) providing combination of a first metal having discrete degenerate dendrites and a plurality of substantially insoluble particles at least partially suspended in the first metal,
   (b) mixing the composite with a second metal at a temperature greater than the solidus temperature of both the first metal and the second metal, said second metal being capable of forming a dendritic structure upon cooling from a liquid state to a solid state, said second metal having a composition substantially different from the composition of said first metal;
   (c) solidifying the mixture into a dendritic structure having a plurality of substantially insoluble particles at least partially suspended in the structure.

* * * * *

UNITED STATES PATENT AND TRADEMARK OFFICE

CERTIFICATE OF CORRECTION

PATENT NO. : 4,432,936

DATED : Feb. 21, 1984

INVENTOR(S) : Earl K. Keith

It is certified that error appears in the above—identified patent and that said Letters Patent is hereby corrected as shown below:

Col. 2, line 15, delete "fummed" and insert --fumed--.

Col. 3, line 23, after the word "protective" insert --atmosphere--.

Col. 3, line 25, delete "method" and insert --metal--.

Col. 4, line 56, delete "," and insert --;--.

Col. 4, line 64, after the ";" insert --and--.

Signed and Sealed this

Seventh Day of August 1984

[SEAL]

*Attest:*

GERALD J. MOSSINGHOFF

*Attesting Officer*

*Commissioner of Patents and Trademarks*